US006587667B2

(12) United States Patent
Hauptmann

(10) Patent No.: US 6,587,667 B2
(45) Date of Patent: Jul. 1, 2003

(54) DEFORMATION DEVICE FOR BENDING A FLEXIBLE SUBSTRATE

(75) Inventor: Gerald Erik Hauptmann, Bammental (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/027,995

(22) Filed: Dec. 20, 2001

(65) Prior Publication Data

US 2002/0093558 A1 Jul. 18, 2002

(30) Foreign Application Priority Data

Dec. 22, 2000 (DE) ..... 100 64 582

(51) Int. Cl.[7] ..... G03G 15/00
(52) U.S. Cl. ..... 399/400
(58) Field of Search ..... 399/322, 400, 399/406; 271/188

(56) References Cited

U.S. PATENT DOCUMENTS 4,378,152 A * 3/1983 Edwards et al. ..... 399/322
4,566,778 A * 1/1986 Sasaki ..... 399/322 X
4,862,215 A * 8/1989 Nomura et al. ..... 399/400
4,876,576 A * 10/1989 Itaya et al. ..... 399/322
5,091,754 A * 2/1992 Abe et al. ..... 271/188 X
5,223,903 A * 6/1993 Russel et al. ..... 399/400
5,515,151 A * 5/1996 Velazquez ..... 271/188 X
5,835,836 A 11/1998 Hirao ..... 399/336
6,032,015 A 2/2000 Umeda et al. ..... 399/306
6,064,852 A * 5/2000 Maekawa ..... 399/400 X
6,169,874 B1 * 1/2001 Quesnel et al. ..... 399/400

FOREIGN PATENT DOCUMENTS

WO 92/06417 4/1992

* cited by examiner

*Primary Examiner*—Fred L. Braun
(74) *Attorney, Agent, or Firm*—Lawrence P. Kessler

(57) ABSTRACT

A deformation device for bending a flexible substrate, being transported by a transport device, into a curved arc shape, thereby taking the flexible substrate out of contact with the transport device, prior to the flexible substrate being transported past a fixing device. As a result, any previously fixed toner on the side of the flexible substrate adjacent to the transport device will not be negatively affected during fixing of toner on the other side of the flexible substrate. The deformation device includes at least two converging guide rails with a wedge-shaped guide element and at least one air nozzle between the guide rails.

5 Claims, 2 Drawing Sheets

DEFORMATION DEVICE FOR BENDING A FLEXIBLE SUBSTRATE

FIELD OF THE INVENTION

The invention relates to a digital printing or copying machine with at least one fixing device for fixing of toner, which has been transferred to a flexible substrate, where the substrate is bent before fixing.

BACKGROUND OF THE INVENTION

Digital printing or copying machines are known which utilize for example the electrographic process in which a latent electrostatic image is developed by charged toner particles. The latter are transferred to an image receiving substrate, hereinafter substrate for short. Then the developed image, which has been transferred to the substrate, is fixed by the toner particles being warmed or heated and melted. To melt the toner particles, contact-making methods are often used, in which the toner particles are brought into contact with the corresponding fixing device, for example hot rollers or drums. The disadvantage here is that generally the use of silicone oil as the separating agent, which is designed to prevent adhesion of the melted toner to the heater, is necessary. Furthermore, building and maintaining these contact-making heaters are complex and thus operating costs are high. In addition, the fault rate caused by the contact-making heaters is relatively high. To fix the toner, which has been transferred for example to paper, noncontact heaters and processes are known, in which for example the toner particles are melted using thermal/microwave radiation or hot air.

In the contact making and noncontact melt processes for example toners are used, which have a glass transition temperature $T_G$ which is in the range from 45° C. to 75° C. The glass transition temperature at which the toner, proceeding from the solid state, begins to become soft, can be influenced by the choice of raw materials and by adding certain additives to the toner. In a fixing device, which has at least one heater for the toner, both the toner and also the substrate itself are heated. To be able to ensure good fixing of the toner on the substrate, the surface temperature of the substrate must be in the area of the glass transition temperature of the toner or above. The toner reaches or exceeds the glass transition temperature ($T_G$) in the area of the heater.

Printing and copying machines are known in which the substrate is printed or coated on both sides. For printing of the front and back, the same image generating and transfer device and heater or one separate image generating and transmission device and heater at a time are used. To fix the toner image, the substrate is often guided past at least one image generating and transfer device and the assigned heater using a transport belt on which the substrate lies. First of all, a first toner image is transferred to the first substrate side and fixed. Then a second toner image is transferred to the second substrate side and fixed. When the second toner image is melted, the first substrate side with the already fixed first toner image located on it adjoins the transport belt. The disadvantage here is that while the second toner image is being melted, the first toner image can be heated to such an extent that it becomes soft and tends to stick to the transport belt. This can lead to several undesirable effects: The sticking can lead to damming of the substrate when the substrate is transferred from the transport belt to a following part of the machine. Furthermore, the appearance of the toner image can change in the areas in which it has adhered to the transport belt. This leads to problems in image quality, for example the toner image has a nonuniform gloss.

SUMMARY OF THE INVENTION

The object of the invention is to provide a printing machine in which double-sided printing and/or coating of a substrate with simultaneously high quality of the images or coatings applied to the front and back of the substrate is possible.

To achieve this object, a digital printing or copying machine includes at least one fixing device, which has a heater for fixing of a toner image which has been transferred to the substrate. The toner image can be monochrome or polychrome. In conjunction with this invention a "toner image" is defined also as a coating, which has at least one toner image. The substrate has a certain flexibility and can for example be a sheet or continuous web, for example paper or cardboard. To fix the liquid or dry toner on the substrate, it is routed past the fixing device by a transport, for example a transport belt or a support plate. The printing or copying machine includes a deformation device with which the flexible substrate is bent such that it has at least one arc. The curvature of the substrate is at least so large that its front and back, of which one side can have the toner image to be fixed and the other side can optionally have an already fixed toner image, have no contact with the transporting surface. The construction of the deformation device and its arrangement within the machine are chosen such that the substrate is bent enough at least in sections when it reaches the action area/fixing area of the fixing device. Based on the defined bending of the substrate so that it does not have any mechanical contact with other components or transport devices or the like, it can be ensured that when a toner image located on one substrate side is being fixed, an already fixed toner image located on the other substrate side is not damaged. Therefore uniform image quality and uniform gloss of the toner images on the front and back of the substrate can be ensured.

The deformation device is made such that the substrate is already bent enough before it enters the fixing area or that, as it enters the fixing area, it is continuously bent further and further until it finally has the desired arc. In one advantageous embodiment of the machine, it is provided that the deformation device deforms the substrate in the elastic range. The substrate is therefore not permanently deformed so that it can be smoothed again—preferably automatically as a result of the material-dictated restoration forces of the bent substrate—after it has left the action area of the deformation device. Therefore damage to the substrate and the toner image(s) fixed on it can be prevented.

According to one development of the invention, it is provided that the deformation device bends the substrate such that, viewed in the substrate transport direction, it has a convex curvature. The substrate is therefore bent around an imaginary lengthwise center axis which runs parallel to the substrate transport direction, by which the distance of its two lengthwise edges to one another is reduced, while the distance between the front edge and the rear edge of the substrate remains at least essentially the same. In other words, bending of the substrate leads to a reduction of the inside width, viewed in the transport direction.

In one preferred embodiment of the machine, the deformation device has at least two deformation elements which each are assigned to one lengthwise edge or one lengthwise edge area of the substrate and exposes it to transverse forces pointed in the direction of the center of the substrate. The bending of the substrate therefore takes place such that the lengthwise edges of the substrate are moved toward one another. According to one advantageous embodiment, it is provided that the deformation elements are formed by at least one stationary guide rail at a time located along the transport path of the substrate. They are made and aligned to one another such that the substrate transported in the direction of the fixing area of the fixing device with its lengthwise edges or lengthwise edge areas bumps one of the guide rails at a time, with a clearance to one another which becomes smaller in the transport direction. The guide rails therefore have a certain inclination, which can be stipulated relative to the substrate transport direction such that the substrate, which is supported on the guide rails with its lengthwise edges, begins to bend in order to equalize the distance between the guide rails, which is becoming smaller. The distance between the guide rails and their inclination relative to the transport direction of the substrate can preferably be set with a corresponding actuating device. Because the deformation device does not have deformation elements, which can be moved in the transport direction of the substrate, the deformation device can be economically produced.

To impart to the substrate the direction into which it is supposed to bend when its lengthwise edges or its lengthwise edge areas are exposed to forces which are pointed in the direction of the middle of the substrate, in one advantageous embodiment there is at least one nozzle which can be directed against the flat side of the substrate for exposing the substrate to a preferably gaseous jet of a medium. Preferably the substrate is exposed to compressed air.

Furthermore, an embodiment of the machine is preferred, on which, in the free space between the guide rails, there is at least one guide element which is made in a wedge shape, which projects into the substrate transport plane and which is used as a ramp for the substrate. The substrate, which is transported for example by the transport device in the direction of the fixing area, bumps with its front edge against the wedge-shaped guide element which projects into its transport path and slides along its wedge surface. In doing so the substrate is supported with its lengthwise edges/lengthwise edge areas on guide rails, which run toward one another, by which the substrate is bent in the desired manner and direction. The bending direction is therefore dictated by the wedge-shaped guide element.

According to one development of the invention, it is provided that at least one nozzle is integrated into the wedge-shaped guide element to support the bending of the substrate. This yields a space-saving construction.

One embodiment of the machine is also preferred in which the substrate which has at least one arc within the fixing area, especially within the action area of the fixing device heaters for melting the toner, can be moved in the transport direction by the transport device, while maintaining its bent shape. In the preferred embodiment the transport device has several transport elements, which can be moved in the transport direction, of which two at a time are assigned to one lengthwise edge or lengthwise edge area of the substrate, one of the lengthwise edges/lengthwise edge areas at a time being held by clamping between two transport elements at a time. The transport elements can each be formed for example by a transport belt or chain, a transport roller or the like.

In another embodiment of the machine according to this invention, the substrate, which has at least one arc within the fixing area, is guided in the transport direction while maintaining its bent shape by a guide, which has several stationary guide elements. The guide elements are formed for example by guide rails which are aligned parallel to one another and to the substrate transport direction, their distance corresponding to the inside width of the bent substrate. To guide the substrate easily past the fixing device, in one advantageous embodiment it is provided that the substrate transport direction runs in the area of the fixing device in the vertical direction and the substrate is transported by the force of gravity acting on the substrate. The force, which causes displacement of the substrate in the transport direction, is therefore produced among others by the inherent weight of the substrate which has an arc and which is supported on the guide elements. To support the displacement motion of the substrate at least one of its two flat sides can for example also be exposed to compressed air, the compressed air flow having at least one directional component which is pointed perpendicular to the flat side and one component which is parallel to the substrate transport direction.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

The deformation device 3 described below can be used in general in conjunction with a digital printing or copying machine 1, especially for those which work using the electrographic or electrophotographic process. Purely by way of example, it is assumed that the flexible substrate is a sheet of paper, onto the front and/or back of which at least one toner image at a time is to be transferred and fixed in a conventional manner. The respective toner image is applied by an image generating and transfer device to one side of the substrate in a conventional manner, and using a heater which is part of the fixing device of the machine, is melted and fixed. The heater is preferably made such that the toner image is melted without mechanical contact. To do this the toner image is exposed to hot air, heat radiation and/or microwave radiation or the like. The structure and the function of these devices are fundamentally known so that they need not be detailed here.

Figure 1:
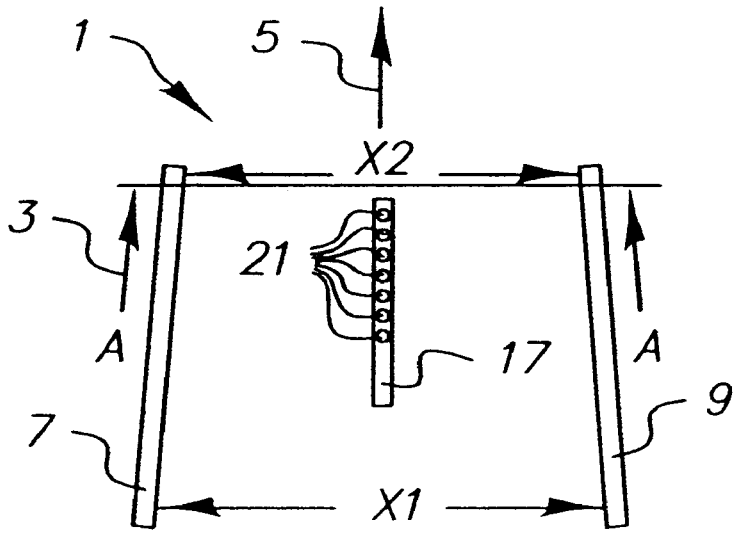
FIG. 1 shows a plan view of one embodiment of the deformation device according to the invention.

FIG. 1 shows a portion of the printing and copying machine 1, specifically a plan view of the deformation device 3, which, viewed in the substrate transport direction 5, is upstream of a fixing device, which is not shown. The deformation device 3 has stationary guide rails 7 and 9, which are each assigned to one lengthwise edge of the substrate, which is not shown in FIG. 1. In this connection "stationary" is defined as the guide rails 7, 9 during normal operation of the machine 1 being located in a constant position. The guide rails 7, 9 are inclined relative to the substrate transport direction 5 such that they run toward one another in the substrate transport direction. The guide rails 7, 9 are used to transfer a substrate arriving from an upstream part of the machine 1 to the following fixing device and in doing so to elastically bend it around its middle axis which runs in the substrate transport direction 5 such that it has an arc. In this connection an "arc" is defined as a slight curvature of the substrate.

The guide rails 7, 9 are inclined relative to the substrate transport direction 5 such that they run onto one another in the direction to the following fixing device. The distance between the guide rails 7, 9 therefore becomes smaller in the direction to the fixing device. In their inlet area the guide rails 7, 9 have a distance X1 to one another which corresponds roughly to the width of the not yet bent substrate, which has plane flat sides, or is greater than it. On their end facing the fixing device the guide rails 7, 9 have a distance X2 which is any case is smaller than the width of the substrate, which is not bent.

Figure 3:
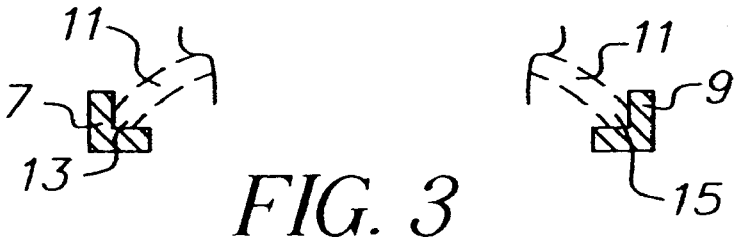
FIG. 3 shows a cross section through the deformation device along the traverse A—A shown in FIG. 1.

As is apparent from FIG. 3 which shows one cross section through the deformation device 3 along the traverse A—A which is shown in FIG. 1, the guide rails 7, 9 have an L-shaped cross section and are thus aligned relative to the substrate transport direction 5 such that one of their legs at a time runs transversely and the other leg runs perpendicular to the substrate transport direction 5. The broken line shows a substrate 11 which is located in the deformation device 3, and its first lengthwise edge 13 is guided by the guide rail 7, and its second lengthwise edge 15 is guided by the guide rail 9. Since the distance between the guide rails 7, 9 is smaller than the width of the substrate 11, the lengthwise edges 13, 15 are moved toward one another, by which the substrate 11 begins to bend. The function of the guide rails 7, 9 is detailed below.

Figure 2:
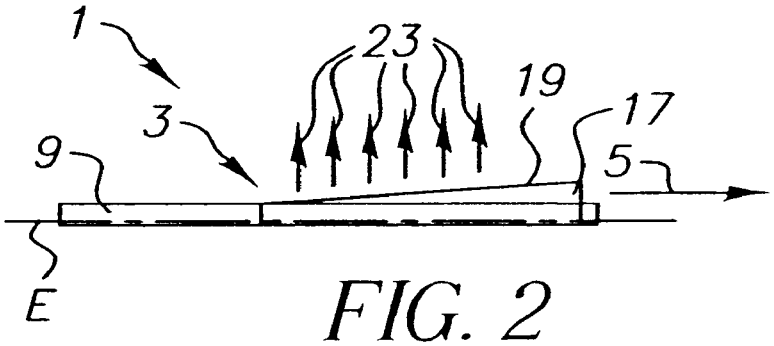
FIG. 2 shows a side view of the deformation device as shown in FIG. 1.

As follows from FIG. 1 and from FIG. 2 which shows one side view of the deformation device 3, in the free space between the guide rails 7, 9 there is a guide element 17 which is made wedge-shaped and which projects with a guide surface 19 which rises in the substrate transport direction 5 into the transport plane E of the substrate 11. Several nozzles 21 which are located at a distance from one another in the substrate transport direction 5 are integrated into the guide surface 19 of the guide element 17. Using the nozzles 21, the substrate 11 can be exposed to a compressed air jet. For this purpose the nozzles 21 are connected to a compressed air supply, which is not shown. The air jets 23 emerging from the nozzles 21 are indicated in FIG. 2 by arrows. It is apparent that the nozzles 21 are aligned such that the air jets 23 strike the flat side of the substrate 11 facing the guide element 17 essentially perpendicularly. The toner image to be fixed is located on the flat substrate side, which faces away from the nozzles 21.

Function of the deformation device 3: The substrate 11 is supplied to the deformation device 3 from an upstream part of the machine 1. The substrate 11 is introduced into the deformation device 3 such that its lengthwise edges 13, 15 travel between the guide rails 7, 9. Using the transport, which is not shown in the figures, the substrate 11 continues to move in the transport direction 5 in the direction to the fixing device. In doing so the lengthwise edges 13, 15 of the substrate run against the vertically running legs of the guide rails 7, 9 with a distance to one another which becomes smaller and smaller in the transport direction 5. At roughly this instant the front edge of the substrate 11 bumps the guide surface 19 of the guide element 17 which is made as a ramp, which surface projects into the transport path of the substrate 11, and is pressed upward in its middle area as it continues to be transported by the guide element 17. The bending of the substrate is supported by the compressed air jets 23. Since the lengthwise edges 13, 15 are supported on the slide rails 7, 9 and cannot deviate laterally, the substrate 11 can be bent up in the vertical direction.

Figure 4:
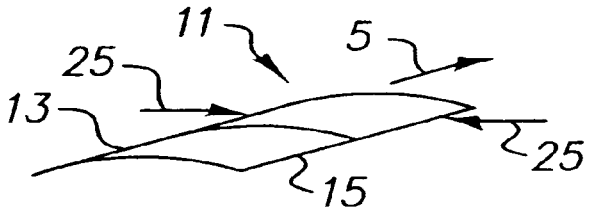
FIG. 4 shows a perspective of a substrate which as already been partially bent by the deformation device.

FIG. 4 shows the substrate 11 in the position within the deformation device 3 in which it is already almost half bent, while its back half, viewed in the substrate transport direction 5, is still flat. The compressive forces 25 applied by the guide rails 7, 9 to the front half of the substrate 11 are indicated by arrows. After the substrate 5 has been completely guided through the deformation device 3, and in doing so is bent to a defined degree by the guide rails 7, 9 and the wedge-shaped guide element 17 with the aid of the air jets 23, it has the desired curvature as is shown in FIG. 5.

Figure 5:
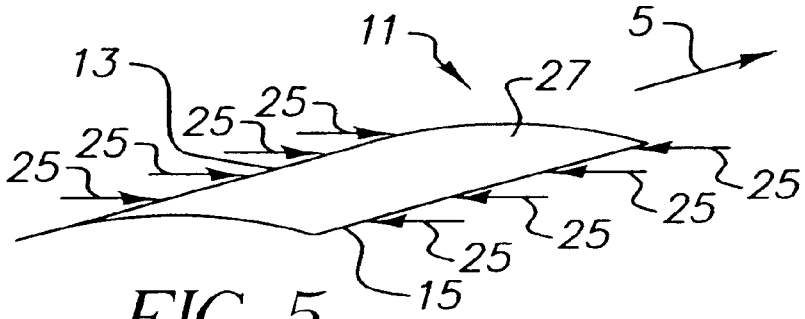
FIG. 5 shows a perspective of the substrate which has already been bent uniformly over its entire length.

FIG. 5 shows the substrate 11 bent uniformly over its entire length, and it has a curvature which is convex when viewed in the substrate transport direction 5. The toner image which is to be fixed, and which is not shown, is located on the convexly curved outer side 27 of the substrate 5. The stability of the bent substrate 11 is given by the guide rails 7, 9, on which the substrate 11, which has been curved to a defined degree, is supported with its lengthwise edges 13, 15.

Figure 6:
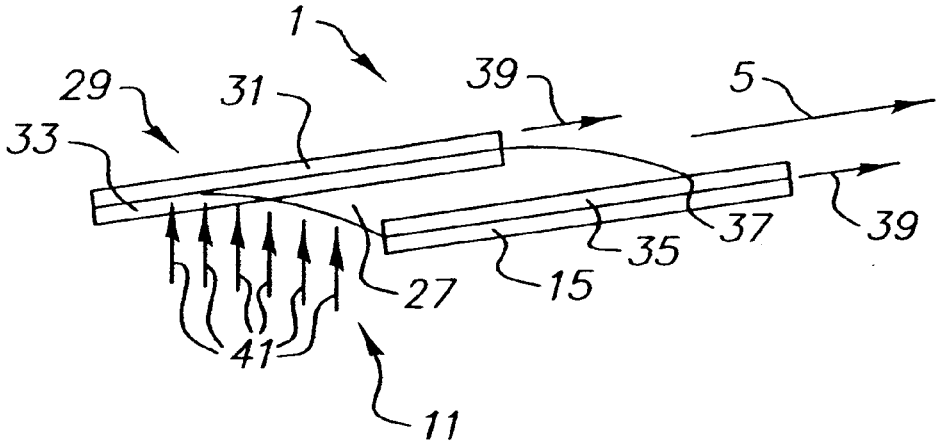
FIG. 6 shows an extract of one embodiment of a transport device for displacement of the substrate, which has an arc past the fixing device.

The substrate 11 which has been bent to a defined degree using the deformation device 3 is picked up by a transport device 29 which is located downstream of the deformation device 3 while it retains its bent shape; FIG. 6 shows one embodiment. To bend different substrate formats and substrates with varying stiffness using the deformation device 3 in the desired manner, the distance between the guide rails 7, 9 which do not run parallel to one another can be adjusted, especially also their inclination relative to the substrate transport direction 5. In this way different degrees of bending of the substrate can be accomplished.

FIG. 6 shows a portion of the transport device 29, which comprises several transport elements 31, 33, 35 and 37, which are each formed here by a transport belt. The transport elements 31 to 37 can be moved, using a drive which is not shown, parallel to the substrate transport direction 5. The transport elements 31 and 33 are assigned to the lengthwise edge 31 and the transport elements 35 and 37 are assigned to the lengthwise edge 15 of the substrate 11. The lengthwise edges are held by clamping by the respective transport elements. The distance between the parallel running transport elements 31, 33, and 35, 37 is chosen such that the bending of the substrate 11 caused by the deformation device 3 is preserved. The substrate 11, using the transport device 29, is routed past the fixing device which is not shown and which is located above the flat side (top) of the substrate 11 which has the toner image to be fixed and the fixing device causes the toner image to melt and fixes it preferably without mechanical contact. To do this the fixing device can expose the toner image to thermal and/or microwave radiation and/or hot air. Because the substrate 11 is bent during the fixing process and its flat side (bottom) facing away from the toner image to be fixed is located freely in the air and has no contact to any part of the machine, it can be ensured that the image quality of a toner image which is located on the substrate bottom, therefore the inside of the arc, and which has already been fixed in a pervious processing step, is not influenced by the heating of the toner image located on the substrate top. Since the toner image on the substrate bottom has no contact with the surface, it cannot stick anywhere.

While the substrate 11 is being routed past the fixing device using the transport device 29, the substrate bottom can be exposed to compressed air 41, by which an air cushion which stabilizes and supports the arc forms on the flat side of the substrate 11 facing away from the toner image to be fixed. This is especially advantageous for very thin substrates, which have only low or insufficient stiffness. The compressed air 41 applied to the bottom of the substrate is metered such that the toner image which is located on the substrate and which is to be fixed is not influenced by it. The air flow produced using the compressed air 41 can be laminar or turbulent. Exposing the substrate bottom to compressed air is optional; i.e., for thicker substrates, which have enough inherent stiffness, it can optionally be abandoned.

The distance between the transport elements 31 to 37 can be set so that different substrate formats and substrates with different stiffnesses and formats can be easily transported.

The deformation device 3 according to the invention can be used especially advantageously for double-sided printing and/or coating of the substrate, regardless of whether the machine 1 has only one image generation and transfer device and a heater, by which the two substrate sides are printed, or for each of the substrate sides there are separate image generation and transfer device and heater each. Of course the deformation device 3 can also be used in a machine in which only one of the substrate sides is printed or coated.

For the embodiment of the machine 1 described using FIGS. 1 to 6, the transport path of the substrate 11 runs at least in the area of the deformation device 3 and the downstream fixing device parallel or essentially parallel to an imaginary horizontal line. In another embodiment, which is not shown in the figures, it is provided that the transport path of the substrate in the area of the deformation device 3 and/or the downstream fixing device runs vertically or essentially vertically, following gravity, from top to bottom. In this way, the transport of the substrate is at least supported by gravity, whereby, optionally, movable transport elements, for example transport belts, rollers or the like, can be abandoned. When the substrate 11 is moved vertically solely by the force of gravity, the speed of the substrate can be set for example by influencing the frictional forces between the lengthwise substrate edges 13, 15 and the guide rails 7, 9. In this way the surfaces of the guide rails 7, 9 which come into contact with the substrate can be roughened accordingly and/or their inherent elasticity is influenced. Of course, other damping or braking mechanisms can also be used to influence the speed of the substrate within the deformation device 3 and optionally of the downstream fixing device, for example exposing the substrate to a pressurized liquid or gaseous medium.

In the embodiment of the machine 1 which is not shown in the figures, it is provided that the deformation device 3 is integrated into the fixing device, i.e. the substrate 11 is therefore bent only within the fixing device so that optionally the transport device 29 as is described using FIG. 6 can be abandoned. To do this the deformation device 3 must be arranged relative to the heater of the fixing device such that the action area of the heater, viewed in the substrate transport direction, is located in the forward area of the guide rails 7, 9, within which the substrate 11 already has an arc, and its bottom, facing away from the heater, no longer has contact with the transport surface.

In an embodiment which is not shown in the figures, it is provided that electrostatic forces are used to stabilize the curvature of the substrate caused by the deformation device. For this purpose, static charging of the substrate side which has the toner image to be fixed can be used. Furthermore, using a charger, additional electrical charges can be applied to the substrate. In these cases electrodes are located near the substrate surface to be charged and they transfer the required electrical potential in order to produce the required electrical forces on the substrate. In the case of substrates made of metal, the bending of the substrate and the support of the arc can take place by electrical or magnetic influences. To do this, for example electrodes, permanent magnets and/or electromagnets are located near the surface of the substrate.

It is common to all embodiments of the machine 1 that all guide, transport and arc support elements have no disruptive effect on the fixing process.

The embodiments should not be understood as a limitation of the invention. Rather, within the framework of this disclosure numerous modifications and changes are possible, especially those versions, elements and combinations and/or materials which for example by combination or modification can be taken from individual features or elements for process steps which are contained in the drawings and which are described in the general specification and embodiments and the claims, for one skilled in the art with respect to achieving the object, and lead to a new subject matter or new process steps or sequences of process steps by combinable features.

The invention has been described in detail with particular reference to certain preferred embodiments thereof, but it will be understood that variations and modifications can be effected within the spirit and scope of the invention.

Parts list

1 machine
3 deformation device
5 substrate transport direction
7 guide rail
9 guide rail
11 substrate
13 first lengthwise edge
15 second lengthwise edge
17 guide element
19 guide surface
21 nozzles
23 air jet
25 compressive forces
27 outer side
29 transport device
31 transport element
33 transport element
35 transport element
37 transport element
39 arrow
41 compressed air
E transport plane

What is claimed is:

1. Deformation device, for use in a digital printing or copying machine, for bending a flexible substrate (11) being transported by a transport device in a direction to pass a fixing device for fixing toner which has been transferred to said flexible substrate (11), before said flexible substrate (11) passes said fixing device, comprising:

at least two stationary guide rails (7,9), parallel to the transport direction (5) of said flexible substrate (11), each being assigned to one lengthwise edge (13,15) or one lengthwise edge area of said flexible substrate (11), to exert a force on said flexible substrate (11), transverse to the transport direction (5) of said flexible substrate (11), thereby bending said flexible substrate (11) into an arc out of contact with said transport device everywhere except at said lengthwise edges (13,15) of said flexible substrate (11);

at least one wedge-shaped guide element (17), located in the free space between said at least two guide rails (7,9), to act as a ramp for said flexible substrate (11); and at least one nozzle (21), located in the free space between said at least two stationary guide rails (7,9), to direct a jet of a gaseous medium against a first side of said flexible substrate adjacent to said transport device.

2. Deformation device as claimed in claim 1, wherein said toner to be fixed is located on a second side of said flexible substrate away from said at least one nozzle.

3. Deformation device as claimed in claim 1, wherein viewed in the transport direction (5) of said flexible substrate (11), said at least two stationary guide rails (7, 9) are upstream of said fixing device or project into said fixing device.

4. Deformation device as claimed in claim 1, wherein said at least two stationary guide rails (7, 9) have an L-shaped cross section, and converge toward one another obliquely to the transport direction (5) flexible substrate (11).

5. Deformation device as claimed in claim 1, wherein said nozzle (21) is integrated into said wedge-shaped guide element (17).

* * * * *